US005495265A

United States Patent [19]

Hartman et al.

[11] Patent Number: 5,495,265

[45] Date of Patent: Feb. 27, 1996

[54] FAST RESPONSE ELECTRO-OPTIC DISPLAY DEVICE

[75] Inventors: Robert A. Hartman, Eindhoven, Netherlands; Alan G. Knapp, Crawley, Great Britain

[73] Assignee: U.S. Philips Corporation, New York, N.Y.

[21] Appl. No.: 785,675

[22] Filed: Oct. 31, 1991

[30] Foreign Application Priority Data

Nov. 19, 1990 [NL] Netherlands ..... 9002516

[51] Int. Cl.[6] ..... G09G 3/36

[52] U.S. Cl. ..... 345/87; 345/100; 359/55

[58] Field of Search ..... 340/784 C, 784 D, 340/784 F, 813; 359/57, 55, 84, 85, 86; 345/87, 90, 94, 100

[56] References Cited

U.S. PATENT DOCUMENTS

| | | | |
|---|---|---|---|
| 4,298,866 | 11/1981 | Hodemaekers | 340/713 |
| 4,769,639 | 9/1988 | Kawamura et al. | 340/811 |
| 4,801,933 | 1/1989 | Yamamoto et al. | 340/784 |
| 4,855,724 | 8/1989 | Yang | 340/784 |
| 4,892,389 | 1/1990 | Kuijk | 340/784 |
| 5,014,048 | 5/1991 | Knapp | 340/784 |
| 5,032,830 | 7/1991 | Kuijk | 340/784 |

*Primary Examiner*—Ulysses Weldon
*Assistant Examiner*—Matthew Luu
*Attorney, Agent, or Firm*—Bernard Franzblau

[57] ABSTRACT

The response rate of a liquid crystal display device is increased in that capacitive variations in the liquid crystal mixture caused by a different drive voltage or varying capacitances in drive transistors are taken into account in advance. If necessary, the required corrections are performed with a microprocessor, but they are preferably stored in advance in a look-up table.

18 Claims, 2 Drawing Sheets

FAST RESPONSE ELECTRO-OPTIC DISPLAY DEVICE

BACKGROUND OF THE INVENTION

This invention relates to a display device comprising an electro-optical medium between two supporting plates and provided with a system of pixels arranged in rows and columns. The display device includes means for providing row and column connections with selection and data voltages wherein the column connections are provided with column voltages during at least a part of a selection period in which the rows are selected via drive elements.

More generally, the invention relates to a display device comprising at least one pixel with an electro-optical medium between picture electrodes defining the pixel and a drive unit for applying drive voltages to the electrodes.

The invention also relates to a method of manufacturing a display device comprising a system of pixels with an electro-optical medium between electrodes defining pixels and a drive unit for applying drive voltages to the electrodes.

The invention also relates to a device for adjusting such a drive unit.

A display device of this type is suitable for displaying alpha-numerical information and video information by means of passive electro-optical display media such as, for example, liquid crystals, electrophoretic suspensions and electrochromic materials.

A display device of the type described in the opening paragraph is known from Netherlands publication no. 8701420 which corresponds to U.S. Pat. No. 5,032,831 (Jul. 16, 1991) in the name of K. E. Kuijk. In a display device shown in this publication the pixels are given a defined value for each row because the capacitances associated with these pixels are accurately charged or discharged after they have been discharged or charged too far (either accurately or not) To this end such a picture display device is provided with means for applying, prior to selection, an auxiliary voltage across the pixels, which voltage is beyond or on the edge of the voltage range to be used for picture display.

In other display devices the pixels are driven via MIMs or thin-film transistors whose gate electrodes are connected to selection rows and whose source electrodes are connected to data rows.

Notably in liquid crystal display devices the capacitance associated with a pixel may vary with the applied drive voltage and this may detrimentally influence the response time. This influence can be easily demonstrated by way of an example.

A display element or picture cell (pixel) has, for example, a capacitance $C_I$ at a drive voltage $V_I$. When the pixel is driven with a voltage $V_J$ in an address or selection period, the total charge on the pixel will be $C_I V_J$, while the pixel will tend to adjust itself to the capacitance $C_J$ associated with the voltage $V_J$, inter alia, because the liquid crystal material is oriented differently. Due to charge preservation the voltage and the capacitance of the pixel will settle at values $V_K$ and $C_K$ in the non-selection period, for which it holds that $V_K.C_K=C_I.V_J$. In other words, the value $V_J$ to be impressed is usually not reached and when the data remain the same, the pixel will have to be driven at least once at more the value $V_J$, which leads to a delayed response.

Another source of error which leads to an erroneous first adjustment and hence a delayed response in a picture display device using active drive is the so-called DC offset voltage which occurs when using the drive mode in accordance with U.S. Pat. No. 5,032,83, but also when using other drive modes such as, for example, the drive mode using thin-film transistors.

SUMMARY OF THE INVENTION

One of the objects of the present invention is to eliminate the above-mentioned drawbacks as much as possible. It is a further object of the invention to provide a display device having a fast response and minimal or no "image retention", and to provide a method of manufacturing such display devices and apparatus to be used for their manufacture.

The invention is based, inter alia, on the recognition that variations of the voltage across a pixel caused by voltage-dependent capacitances in the pixel can be taken into account in advance.

To this end a display device according to the invention is characterized in that it is provided with correction means which define the column voltages, dependent on externally applied signals.

In this way the pixels are subjected to a pre-adapted drive voltage which at least substantially prevents the above-described delay.

In this case the correction means can be adapted in such a way that they correct for a pixel capacitance which varies with the voltage-adjustment at the transmission/voltage characteristic.

On the other hand the correction means can correct for an externally caused variation of the voltage-adjustment at the transmission/voltage characteristic such as, for example, the variation caused by capacitances of the drive element.

A combination correction is alternatively possible.

Generally, the column voltage to be used in a display device after correction is defined by:

$$V_c = \frac{C \cdot (V') \cdot V'}{C(V)}$$

in which

V: previous column voltage across the pixel,

V': desired column voltage across the pixel, and in which

C(V): the capacitance of the pixel dependent on the column voltage.

The correction stated above can be performed, for example, directly by means of a microprocessor, but this is usually rather cumbersome. It is therefore preferable to use a look-up table in which the digitally coded voltages V, V'generate an address. In a (video) signal of 8 bits this would lead to a 16-bit address, in other words, a RAM or ROM for the look-up table of 64 K correction values. However, in practice it is sufficient to use an addressing accuracy of 12–14 bits so that it is sufficient to use 4K–16K memory sites for correction values. Said RAM, ROM or microprocessor may be present as a separate unit, but it may alternatively form part of a larger memory or drive system which is already present for, for example, signal processing.

Moreover, during selection of a pixel an offset voltage which is also defined by the capacitance of the pixel can be generated across the pixel with a value of:

$$V_{off} = \frac{V_R C_X}{C_X + C_{LC}}$$

($V_R$: amplitude of selection pulse during falling edge, $C_x$: capacitance of drive element, for example, the gate-drain capacitance of a thin-film transistor or the capacitance associated with a diode or MIM (metal-isolator-metal), $C_{LC}$: voltage-dependent capacitance of the liquid crystal). As a result, the voltage across the pixels acquires a value which differs from the externally applied signal voltage. Since both $C_x$ and $C_{LC}$ may be voltage-dependent, a correction can be defined in the same way as described above for the drive voltage of a pixel. This correction can be performed for one of the capacitances $C_x$, $C_{LC}$ separately, or combined for both.

If the external signal differs little from the signal presented during the previous selection period, the correction will usually be small enough to be performed completely within one picture period. In the case of larger differences it may be advantageous to use, as it were, an overcompensation because of the inertia of the pixel and because a larger directing force must be exerted on the liquid crystal molecules. A device according to the invention, in which this is realised, is characterized in that the correction means perform an extra correction at a difference between an externally applied signal and the (column) voltage applied during a previous selection period, which difference is larger than a predetermined threshold value.

A method of manufacturing a display device according to the invention is characterized in that during manufacture at least a part of the drive unit is adjusted in such a way that, dependent on applied signals, the drive unit supplies the electrodes such drive voltages such that a deviation of the transmission level of a pixel due to a voltage-dependent behaviour of the pixel is at least partly compensated for.

BRIEF DESCRIPTION OF THE DRAWING

The invention will now be described in greater detail with reference to some embodiments shown in the drawings, in which.

DESCRIPTION OF THE PREFERRED EMBODIMENTS

Figure 1:
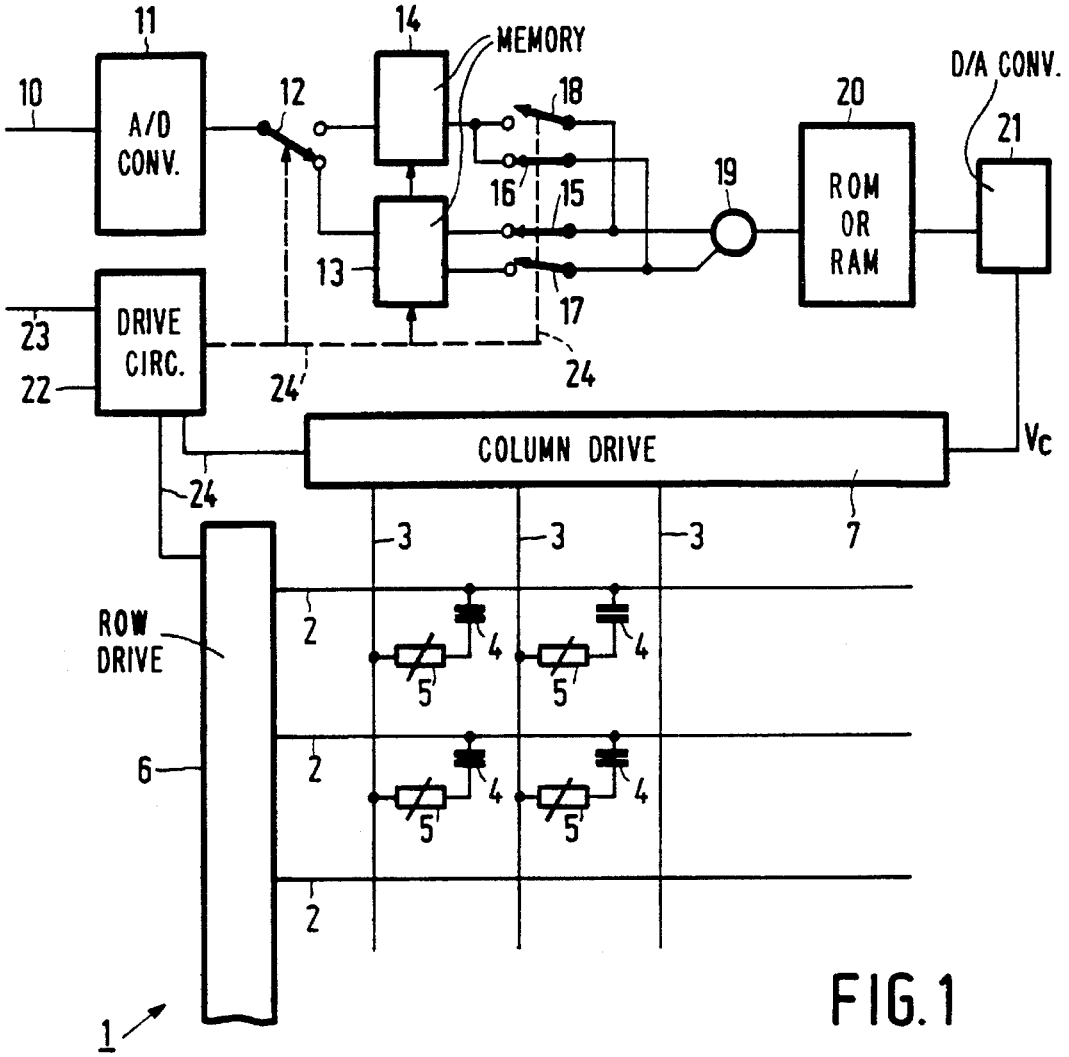
FIG. 1 shows diagrammatically a display device according to the invention.

The Figures are diagrammatic and corresponding components are generally denoted by the same reference numerals.

The display device of FIG. 1 comprises a plurality of pixels 4, for example, liquid crystal pixels arranged in rows and columns. These pixels are driven via switching elements 5, for example, diodes or MIMs (metal-isolator-metal) and are arranged in a matrix configuration. Information present at the column electrodes 3 is presented to the pixels 4 by successively selecting (energizing) row electrodes 2. Row electrodes 2 are successively selected by means of, for example, a shift register 6, while the information to be presented for a selected row of pixels is stored in a register 7.

An incoming video signal 10 may be directly connected to the register 7 for this purpose. The voltages at the column electrodes 3 are then equal to the presented video voltages for each pixel. Dependent on the drive mode, the switching elements 5 used in the matrix (diodes, MIMs, TFTs), the column voltages and the selection voltages at the row electrodes 2, which voltages originate from the shift register 6, a pixel 4 is subjected to a voltage $V_1$ during selection. The liquid crystalline material which is used for the pixels has a given voltage-dependent dielectric constant. The capacitance of a pixel is therefore voltage-dependent and a given capacitance $C_I$ is associated with the voltage $V_I$. If the voltage is $V_J$ in a subsequent frame or field period during selection, the pixel acquires a charge $C_IV_J$ during the selection interval. Due to charge preservation the voltage across the pixel changes during the non-selection interval to a value $V_K$, for which it holds that: $V_KC_K=C_IV_J$ (possible charge losses due to, for example, leakage currents have not been taken into account in this case). The pixel thus does not immediately acquire the desired voltage $V_J$ (and the associated capacitance $C_J$), which becomes manifest in a delayed response.

According to the invention this can be prevented by giving the data or column voltages a corrected voltage $V_C$ in advance, for which it holds that:

$$V_c = \frac{V_d C_d}{C(V)}$$

so that the pixel acquires a charge $C_IV_C=V_dC_d$ which corresponds to the desired adjustment.

More generally:

$$V_c = \frac{C(V') \cdot V'}{C(V)}$$

in which:

C(V): voltage-dependent capacitance of the pixel;

V: previous column voltage (or voltage across the pixel);

V': desired column voltage (or voltage across the pixel).

FIG. 1 shows a device with which the above-described voltage $V_C$ can be generated.

The incoming video signal 10 is convened by means of an A/D converter 11 into digital signals of, for example, 8 bits which are stored in a first memory 13 via a first switch 12. Dependent on the mode of operating the display device during a previous frame or field period, a second memory 14 is charged with the associated video information. The previous field here means the previous field of the same kind (odd or even). When one of the rows is selected (row electrodes 2), the digital information associated with this row is passed on for each column 3 from the memories 13, 14 to an address circuit 19 (for example, an address register) via the switches 15, 16. The drive circuit 22, which receives a synchronizing signal 23, ensures the mutual synchronization of the different switches, registers, memories, etc. via drive lines 24.

The position of the switches 15, 16 is such that the 8 bits from the first memory 13 constitute the most significant part of the address in the address circuit 19 which drives a look-up table 20. The least significant address bits are constituted by the m most significant bits from the second memory 14. The reference m indicates, for example, a value of between 4 and 8. At m=4 it is sufficient to use a memory capacity of the look-up table 20 of 4 k memory sites, while nevertheless obtaining a satisfactory correction.

The look-up table 20, which comprises, for example, a ROM or RAM, is programmed in such a way that a corrected drive value defined by the above-mentioned formula is passed on (in a digital form) to the D/A converter 21. The corrected column voltages converted to analog values are then loaded into the register 7.

Dependent on the drive mode, a second memory 14 is loaded with video information during a subsequent frame or field period by changing over switch 12. When the rows 2 are being read, the switches 15, 16, 17, 18 are changed over. The most significant part of the address in the address circuit 19 now comes from the second memory 14 via switch 18, while the least significant part comes from the first memory 13 via switch 17, in which memory video information has been stored during a previous frame (field) period. Data voltages which are largely corrected for capacitance variations of the electro-optical material (liquid crystal material) in accordance with the previously mentioned formula are thus presented to the column electrodes 3 via the look-up table 20 and the D/A converter 21. This compensation will lead to a faster response, notably at larger variations of the voltage across a pixel.

Figure 2:
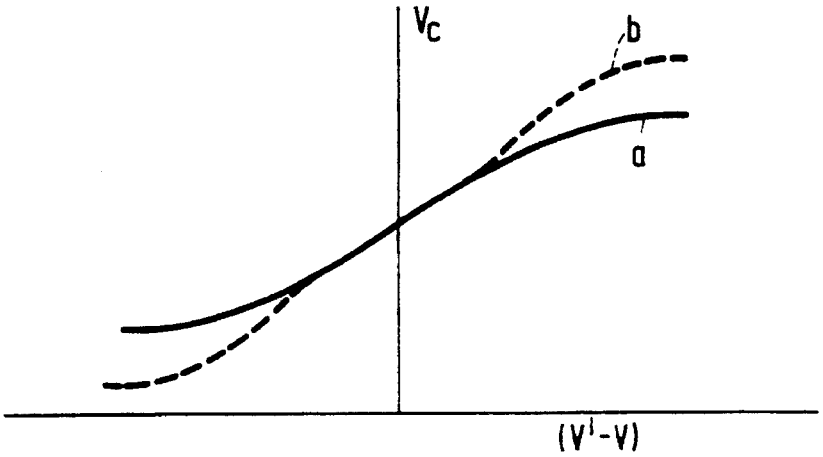
FIG. 2 shows diagrammatically several correction possibilities.

FIG. 2 shows by way of example how the corrected voltage $V_C$ may vary (line a) as a function of the difference between a voltage (V') presented for a given pixel and the voltage for the same pixel during a previous selection (V). The relation shown in FIG. 2 can be realised by means of the look-up table 20, but also, for example, by means of a microprocessor.

The rate at which the liquid crystal molecules assume a different orientation upon voltage variations may still be too slow at larger voltage variations (for example, due to too weak reorientation forces). Consequently, the desired transmission value is not immediately reached in the first selection period, even if the above-mentioned correction is used. In that case a correction which, as it were, is too large may be performed for large deviations between a previous column voltage V and a desired column voltage V'. The correction voltage which is dependent on (V'−V) is then defined, for example, by means of a relation which is partly illustrated by means of broken lines (line b). This correction can be implemented by means of a look-up table 20. At larger values of (V'−V) there is, as it were, overcompensation, while the original compensation is maintained at smaller values.

Figure 3:
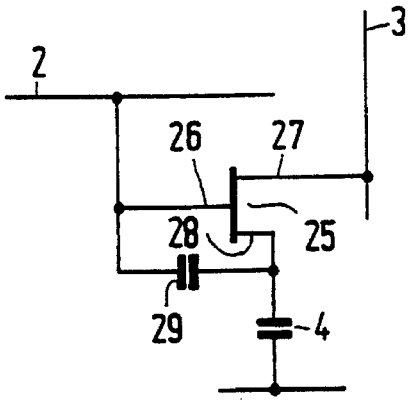
FIG. 3 shows the drive of a pixel via a thin-film transistor.
Figure 4A:
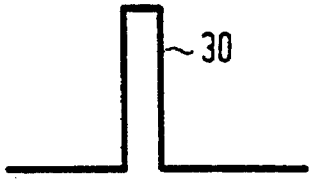
FIGS. 4(*a–b*) shows the associated drive signals and voltages across the pixel.
Figure 4B:
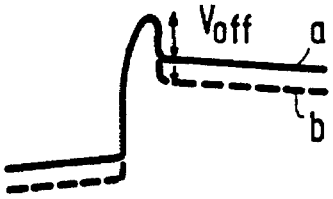

FIG. 3 shows diagrammatically a pixel 4 which is driven by a thin-film transistor 25 and which forms part of a display device arranged in a matrix configuration comparable with that of FIG. 1. A row electrode 2 is connected to the gate electrode 26 of the transistor 25, while the column electrode 3 is connected to the source contact 27. The drain contact 28 is connected to the pixel 4 which has a voltage-dependent capacitance ($C_{LC}$). The capacitance 29 represents a capacitance Cx associated with the transistor 25 (channel capacitance, gate-drain capacitance). Due to capacitive coupling this capacitance produces an offset voltage across the pixel with a value of:

$$V_{off} = \frac{V_R \cdot C_X}{C_X + C_{LC}}$$

at the falling edge of a selection pulse 30 (FIG. 4*a*) on the row electrode 2. ($V_R$: amplitude selection pulse, falling edge). Since $C_{LC}$ is voltage-dependent again (and is thus a function of the voltage across the pixel), $V_{off}$ is also voltage-dependent. A high capacitance $C_{LC}$ leads, for example, to a response of the pixel as is illustrated by means of curve a in FIG. 4*b*, whereas a lower value gives rise to curve b. The voltage drop $V_{off}$ across the pixel can be compensated again by employing a correction compensating for this voltage drop, dependent on the applied drive voltages.

Figure 5:
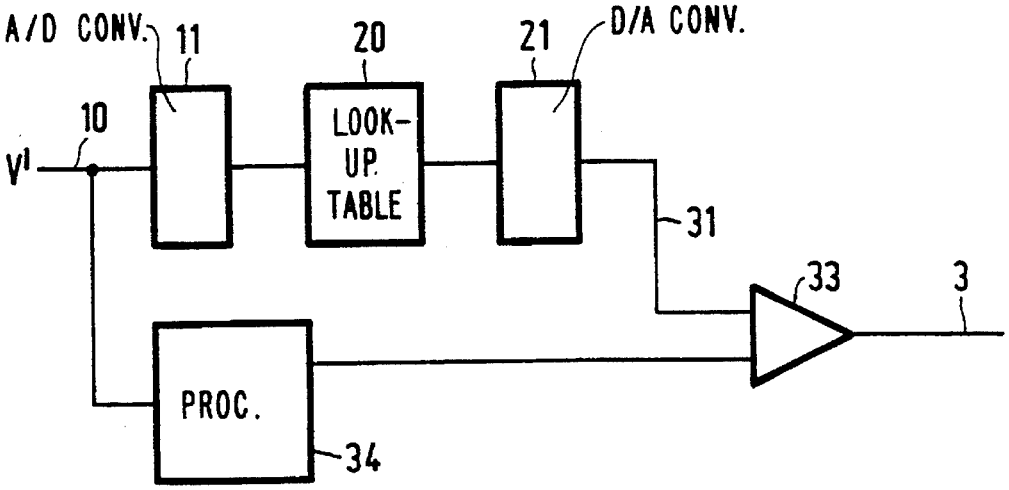
FIGS. 5 and 6 show some forms of correction possibilities according to the invention.
Figure 6:
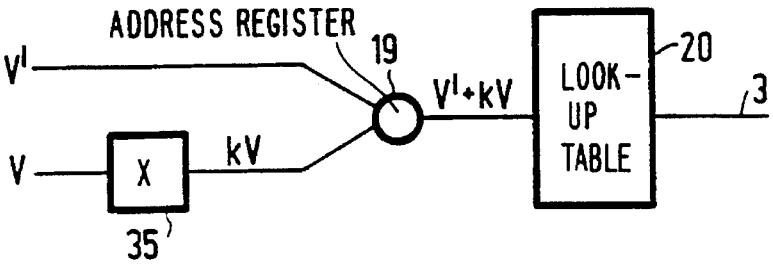

To this end the external signal 10 is again applied to an A/D converter 11 (FIG. 5). It addresses a look-up table 20 whose output supplies a (digitized) corrected voltage value and which, if desired, also is corrected the voltage dependency of $C_x$. A correction voltage 31 is obtained via a D/A converter 21. The normally processed signal 32 from the processor 34 is added to the correction voltage by means of the circuit 33 which applies the correct voltage to the column electrodes 3.

Similarly, corrections can be performed for matrices which are driven with diodes or MIMs.

This correction may of course also be combined with that described with reference to FIGS. 1, 2.

The correction may also be based on a weighted average of the digital values of the voltages V'and V, in which, for example, V is multiplied by a factor k in the circuit 35 and subsequently the (digitized) voltages V'and kV are added in an address register 19 of the look-up table 20.

To program the look-up table 20, for example, the voltage dependence of the liquid crystal capacitance is determined first. The correction which must be stored in the look-up table (RAM or ROM) is calculated with reference to the formula:

$$V_c = \frac{C(V') \cdot V'}{C(V)}$$

A device for adjusting the look-up table comprises means for programming a RAM or ROM, for example, in accordance with the correction curve in FIG. 2, either using or not using overcompensation, or in accordance with the formula:

$$V_{off} = \frac{V_R \cdot C_X}{C_X + C_{LC}}$$

if there is only a correction for the voltage drop at the end of a selection pulse. In that case $V_R$ and $C_X$ must also be known. The two corrections can of course also be provided jointly in a look-up table in the form of a ROM or RAM. The device need not exclusively comprise programming means but it may be simultaneously equipped with apparatus for measuring the capacitance of electro-optical materials (particularly liquid crystal material) or with ready-made matrix panels. Measuring and adjusting may then be coupled directly.

The invention is of course not limited to the embodiments shown, but it is also applicable to other drive modes, such as, for example, a drive matrix based on plasma addressing or addressing by means of an electron beam.

We claim:

1. A display device comprising an electro-optical medium between two supporting plates, provided with a system of pixels arranged in rows and columns, means for providing row and column connections, during operation, with voltages such that column connections are provided with column voltages during at least a part of a selection period in which rows are selected via drive elements, characterized in that the device is provided with correction means which define the column voltages, dependent on externally applied signals provided during the selection period and externally applied signals during a previous selection period of the same column whereby the correction means correct for a variation of pixel capacitance with voltage in the transmission/voltage characteristic.

2. A display device as claimed in claim 1, wherein correction means also correct for variations caused by capacitances of the drive element.

3. A display device comprising, at least one pixel with an electro-optical medium between electrodes defining the pixel, a drive unit for applying drive voltages to the electrodes, and correction means correcting the drive voltages at the electrodes dependent on two successive externally applied signals and on the voltage-dependent behaviour of the pixel.

4. A display device as claimed in claims 2 or 3, wherein the correction means perform an extra correction at a difference between an externally applied signal and the signal applied during a previous selection period, which difference is larger than a predetermined value.

5. A display device as claimed in any one of claims 1, 2 or 3 wherein the correction means comprise a look-up table.

6. A method of displaying data on a display devise comprising a system of electro-optic pixels having a voltage dependent capacitance, said method comprising: applying data signals to the display device, and applying drive voltages to the pixels which are dependent on the applied data signals such that the drive voltages at least partly compensate for a deviation of the transmission level of a pixel due to the voltage-dependent capacitance of the pixel.

7. A method as claimed in claim 6, characterized in wherein the display device further comprises a drive unit for applying drive voltages to the pixels, said method further comprising: defining the capacitance/voltage characteristic of a pixel, determining correction voltages for respective given applied data signals, and adjusting the drive unit such that it supplies a correction voltage as a response to the data signals, which correction voltage entirely or partly defines the drive voltage at the pixels.

8. A method as claimed in claim 6 wherein the display device includes a look-up table containing data related to correction voltages for the pixel drive voltages, said method further comprising; addressing the look-up table by means of the applied data signals whereby the look-up table produces output signals corrected for the voltage-dependent capacitance of the pixels.

9. A method as claimed in claim 8 which further comprises: determining the voltage dependent capacitance characteristic of the pixels, and storing correction data in the look-up table which is a function of the determined voltage-dependent capacitance characteristic of the pixels.

10. A display device as claimed in claims 1 or 3 wherein the correction means includes a threshold device which determines whether the difference between an externally applied signal during a given selection period and the externally applied signal during a prior selection period exceed a given voltage threshold level, said correction means deriving an overcompensation correction voltage when said threshold voltage level is exceeded.

11. A method of displaying data on a display device of the type comprising a system of pixels with an electro-optical medium between electrodes defining the pixels and a drive unit for applying drive voltages to the electrodes, said method comprising: determining the capacitance/voltage characteristic of a pixel, determining correction voltages dependent on respective input signals, and adjusting the drive unit such that it supplies a correction voltage as a response to an input signal, which correction voltage entirely or partly defines the drive voltage at the pixel electrodes.

12. A display device comprising: an electro-optical display medium between two support plates provided with a matrix of row and column electrodes, a system of pixels arranged in rows and columns and which include first and second picture electrodes sandwiching the electro-optical display medium, means for applying selection voltages and data signal voltages to the row and column electrodes, respectively, for the purpose of picture display, wherein said selection voltages are applied to the row electrodes in a row-by-row sequence, and correction means responsive to externally applied signal voltages to produce correction voltages for modifying the data signal voltages to be applied to each column electrode during respective row selection periods, and wherein said correction voltages are determined by the voltage level of the externally applied signal voltages.

13. A display device as claimed in claim 12 wherein the correction means includes a threshold device which determines whether the difference between a column data signal voltage for a given selection period and a column voltage applied during a prior selection period exceed a given voltage threshold level, said correction means deriving an overcompensation correction voltage when said threshold voltage level is exceeded.

14. A display device as claimed in claim 12 wherein the pixels exhibit a voltage-dependent capacitance and the correction means thereby correct for voltage-dependent variations of pixel capacitance.

15. A display device as claimed in claim 12 wherein said means for applying row selection voltages comprise a plurality of drive elements each having a capacitance which produces an offset voltage across its respective pixel, and said correction means correct the voltages applied to the column electrodes so as to compensate for said offset voltage.

16. A display device as claimed in claim 12 wherein said correction means comprises means for storing data defining the capacitance/voltage characteristic of the pixels whereby the correction means modifies the data signal voltages applied to the column electrodes as a function of the stored capacitance/voltage data.

17. A display device as claimed in claim 12 wherein said means for applying row selection voltages comprise a plurality of drive elements each having a voltage-dependent capacitance, and the pixels comprise a voltage-dependent capacitance, and said correction means are responsive to said externally applied signal voltages to modify the column data signal voltages as a function of the level of the externally applied signal voltages in a manner so as to compensate for the voltage-dependent capacitance of the drive elements and the voltage-dependent capacitance of the pixels.

18. A display device as claimed in claim 14 wherein the correction means comprise a look-up table which stores data related to correction voltages, and means controlled by the externally applied signal voltages for addressing the look-up table which thereby supplies to the column electrodes data signal voltages corrected for the voltage-dependent capacitance of the pixels.

* * * * *